US012745831B1

(12) United States Patent
Torpey

(10) Patent No.: US 12,745,831 B1
(45) Date of Patent: Sep. 29, 2026

(54) BACKPACK HAVING INTEGRATED SUPPORT SYSTEM

(71) Applicant: MMI Outdoor, Inc., Montgomery, AL (US)

(72) Inventor: Ryan T. Torpey, Montgomery, AL (US)

(73) Assignee: MMI OUTDOOR, INC., Montgomery, AL (US)

( * ) Notice: Subject to any disclaimer, the term of this patent is extended or adjusted under 35 U.S.C. 154(b) by 66 days.

(21) Appl. No.: 18/382,422

(22) Filed: Oct. 20, 2023

Related U.S. Application Data

(60) Provisional application No. 63/419,927, filed on Oct. 27, 2022.

(51) Int. Cl.
*A45F 3/08* (2006.01)
*A45F 3/04* (2006.01)

(52) U.S. Cl.
CPC ..... *A45F 3/08* (2013.01); *A45F 2003/045* (2013.01)

(58) Field of Classification Search
CPC ..... A45F 3/08; A45F 2003/045
See application file for complete search history.

(56) References Cited

U.S. PATENT DOCUMENTS 8,678,258 B1 3/2014 Knight et al.
8,997,262 B2 * 4/2015 Klein ..... A45F 3/08 2/2.5
9,119,459 B2 * 9/2015 Kim ..... A45F 3/08
10,058,163 B2 * 8/2018 Mather ..... A45F 3/047
10,231,534 B1 3/2019 Meador, III et al.
10,617,195 B2 * 4/2020 Coleman ..... A45F 3/08
11,311,062 B2 * 4/2022 Roque ..... A41D 13/0562
11,363,877 B2 * 6/2022 Wright ..... A45F 3/08
2004/0007605 A1 * 1/2004 Mares ..... A45F 3/20 224/630
2005/0035170 A1 * 2/2005 Sears ..... A45F 3/12 224/628
2006/0163305 A1 * 7/2006 Tong ..... A45F 3/08 224/628
2006/0208024 A1 * 9/2006 Gleason, Jr. ..... A45F 3/08 224/636
2006/0266781 A1 * 11/2006 Howell ..... A45F 3/08 224/628
2012/0012629 A1 * 1/2012 Buffinton ..... A45F 3/08 224/633

* cited by examiner

*Primary Examiner* — Derek J Battisti
(74) *Attorney, Agent, or Firm* — AdamsIP, LLC; Kenneth Bush

(57) ABSTRACT

A backpack having an integrated support system is disclosed herein. The backpack comprises a container having a back panel with an exterior surface and an interior surface, in various aspects. An interior support frame is secured to the panel interior surface, in various aspects. An exterior support frame is secured to the panel exterior surface, in various aspects. The exterior support frame and the interior support frame are in cooperative alignment with each other through the panel such that the exterior support frame and the interior support frame are operable to cooperate with each other to transfer the weight of the backpack and its contents to a waist belt of a user donning the backpack, in various aspects.

4 Claims, 4 Drawing Sheets

BACKPACK HAVING INTEGRATED SUPPORT SYSTEM

CROSS-REFERENCE TO RELATED APPLICATIONS

The present application claims priority to and benefit of U.S. Provisional Patent Application No. 63/419,927, filed on Oct. 27, 2022, the disclosure of which is hereby incorporated by reference herein in its entirety.

FIELD OF THE INVENTION

This disclosure relates to a backpack having an integrated support system for transferring the weight of the backpack and its contents to the waist belt of the user rather than to the shoulders and back of the user.

BACKGROUND OF THE INVENTION

Backpacks having support systems for transferring the weight of the backpack and its contents to the waist belt of the user rather than to the shoulders and back of the user are known, such as the systems described in U.S. Pat. No. 8,678,258 (Knight et al.) and U.S. Pat. No. 10,231,534 (Meador, III et al.), the disclosures of which are incorporated herein by reference in their entireties. The current backpack system is an improvement to these systems.

BRIEF SUMMARY OF THE INVENTION

The present disclosure relates to a backpack having an integrated support system. As disclosed herein, the backpack comprises a container having a back panel with an exterior surface and an interior surface, in various aspects. An interior support frame is secured to the panel interior surface, in various aspects. An exterior support frame is secured to the panel exterior surface, in various aspects. The exterior support frame and the interior support frame are in cooperative alignment with each other through the panel such that the exterior support frame and the interior support frame are operable to cooperate with each other to transfer the weight of the backpack and its contents to a waist belt of the user.

This summary is presented to provide a basic understanding of some aspects of the apparatus and methods disclosed herein as a prelude to the detailed description that follows below. Accordingly, this summary is not intended to identify key elements of the apparatus or methods disclosed herein or to delineate the scope thereof.

Figure 2:
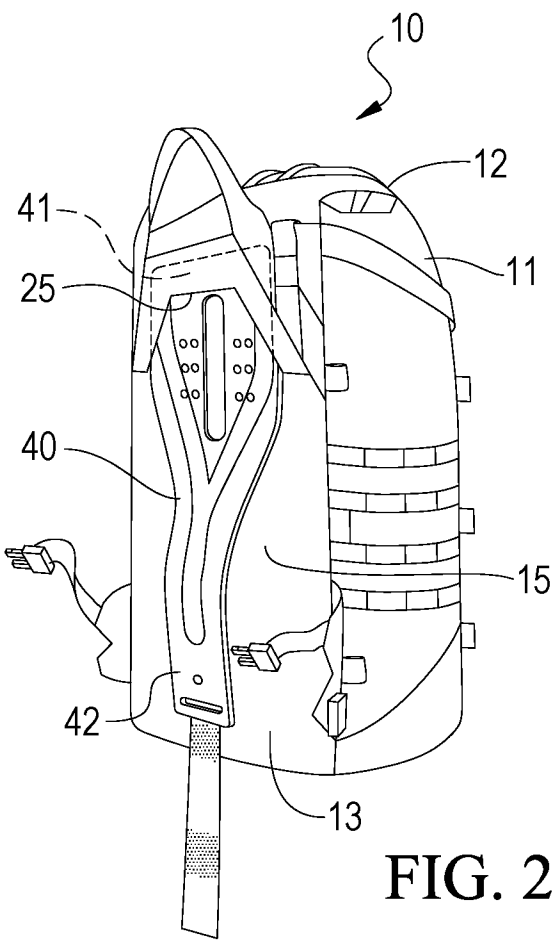
FIG. 2 illustrates by rear perspective view an exemplary exterior support frame inserted into a frame slot formed on the exterior back panel of FIG. 1.
Figure 1:
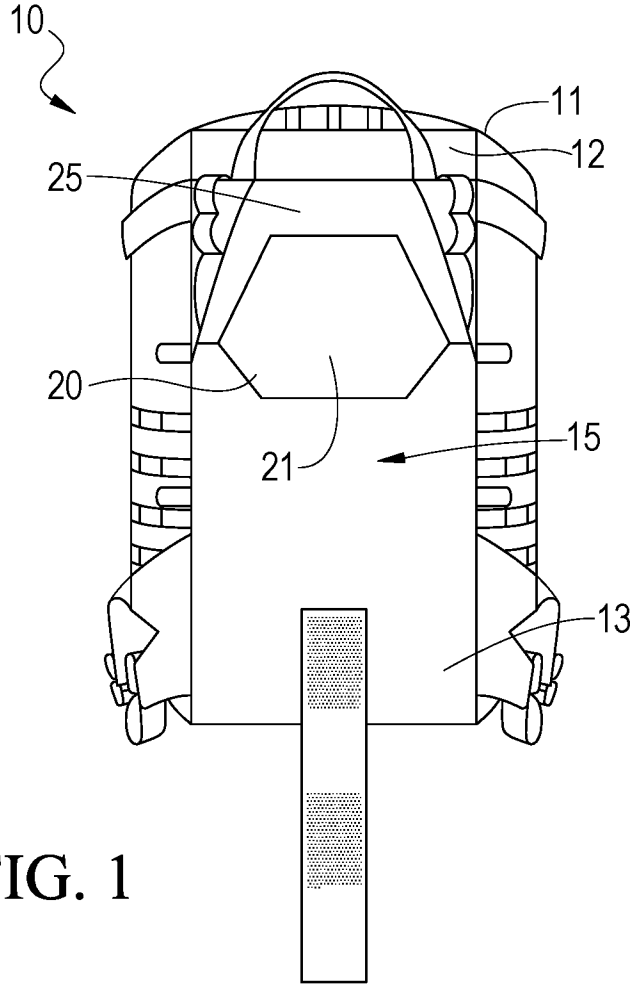
FIG. 1 illustrates by rear elevational view an exterior back panel of an exemplary backpack.
Figure 4:
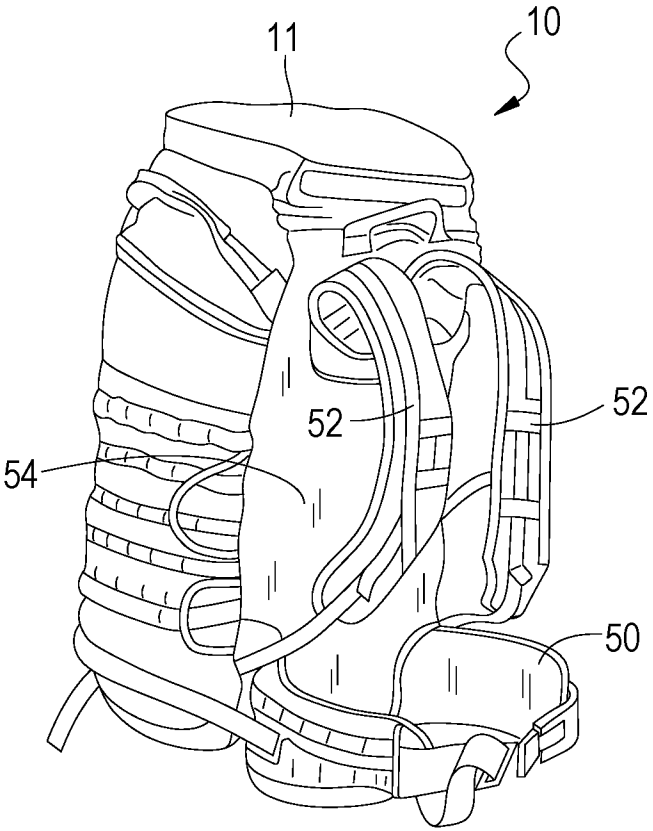
FIG. 4 illustrates by perspective view an exemplary backpack attached to an exemplary harness system.
Figure 3:
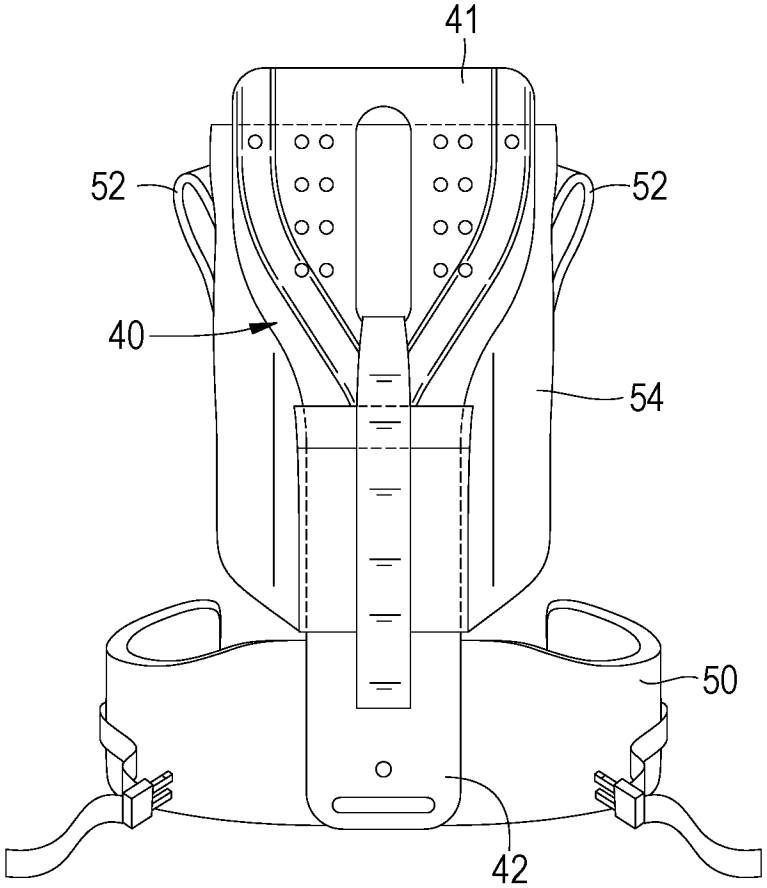
FIG. 3 illustrates by rear elevational view an exemplary harness system formed from an exterior support frame, a waist belt, and shoulder straps.

The Figures are exemplary only, and the implementations illustrated therein are selected to facilitate explanation. The number, position, relationship and dimensions of the elements shown in the Figures to form the various implementations described herein are explained herein or are understandable to a person of ordinary skill in the art upon study of this disclosure. Where used in the various Figures, the same numerals designate the same or similar elements. Furthermore, when the terms "top," "bottom," "right," "left," "forward," "rear," "first," "second," "inside," "outside," and similar terms are used, the terms should be understood in reference to the orientation of the implementations shown in the drawings and are utilized to facilitate description thereof. Use herein of relative terms such as generally, about, approximately, essentially, may be indicative of engineering, manufacturing, or scientific tolerances, or other such tolerances, as would be readily recognized by those of ordinary skill in the art upon study of this disclosure.

DETAILED DESCRIPTION OF THE INVENTION

Figure 6:
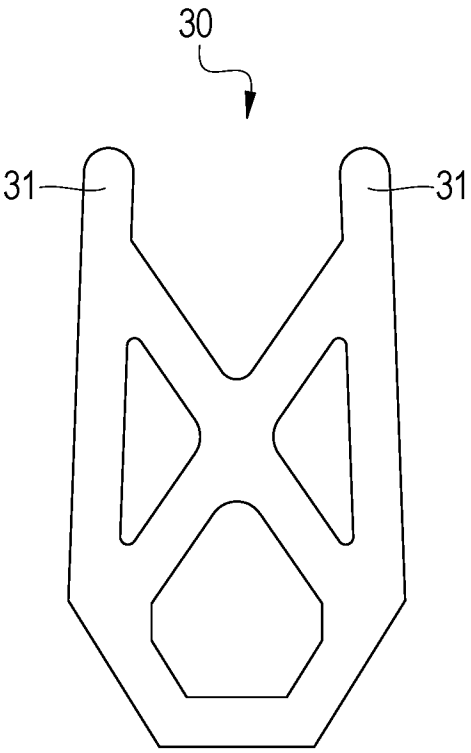
FIG. 6 illustrates by front elevational view an exemplary interior support frame.
Figure 5:
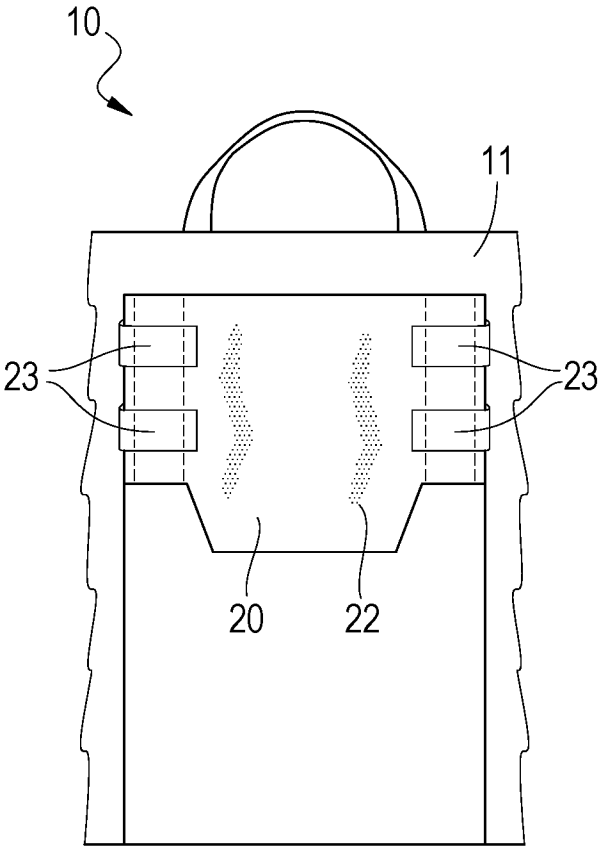
FIG. 5 illustrates by front elevational view an interior back panel of an exemplary backpack.
Figure 9:
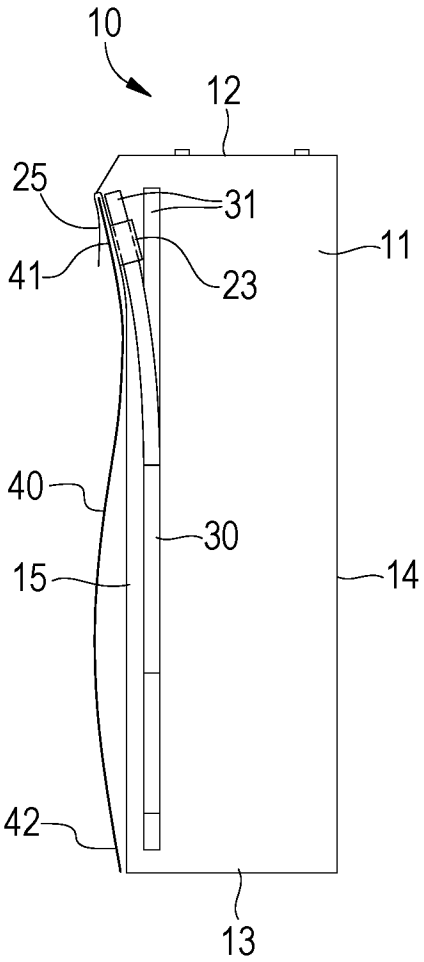
FIG. 9 illustrates by side sectional view the exemplary backpack of FIG. 8 having an exterior support frame inserted into a frame slot and showing the interior support frame in cooperative engagement with the exterior support frame.
Figure 8:
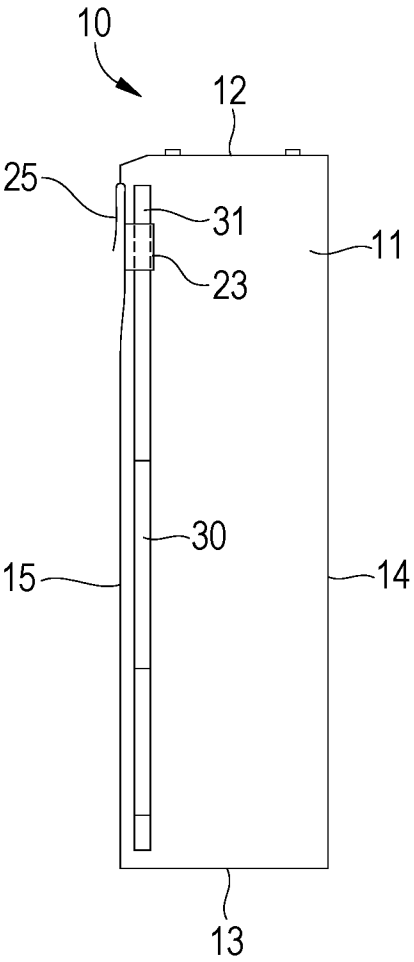
FIG. 8 illustrates by side sectional view an exemplary backpack having an interior support frame secured to the interior back panel.
Figure 7:
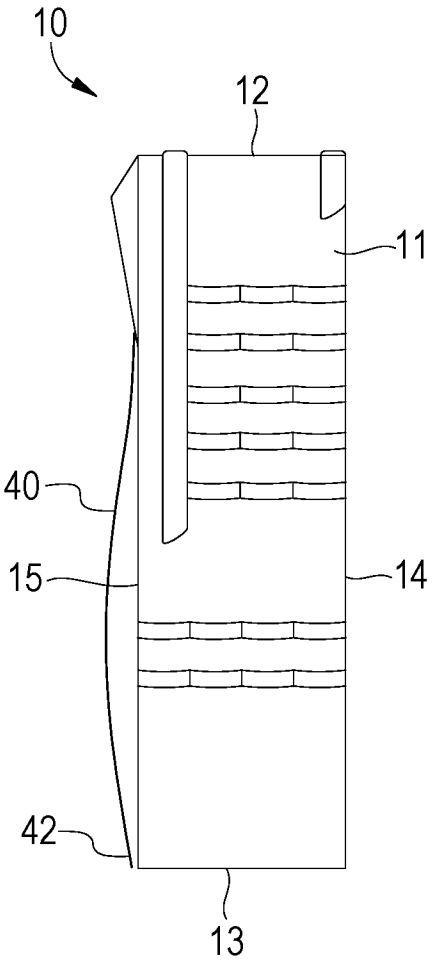
FIG. 7 illustrates by side elevational view an exemplary backpack having an exterior support frame inserted into a frame slot.

The present disclosure relates to backpacks having support systems for transferring the weight of the backpack and its contents to the waist belt of the user rather than to the shoulders and back of the user. In exemplary implementations shown in FIGS. 1-9, a backpack 10 having an integrated support system, as disclosed herein, comprises a container 11 having a top 12, a bottom 13, a front 14, and a back 15, in various aspects. The container back 15 has a panel 20 having an exterior surface 21 and an interior surface 22, in various aspects. An interior support frame 30, such as that shown in FIG. 6, is preferably secured to the panel interior surface 22 by one or more securing straps 23, in various aspects. The interior support frame may have one or more upper extensions 31 that are secured by the securing straps 23. The interior support frame 30 is preferably substantially two-dimensional in shape (i.e., planar) when relaxed, in various aspects. The interior support frame 30 is preferably flexible and resilient, in various aspects.

The container back 15 has a sleeve or slot 25 formed along an upper end of the panel exterior surface 21 for slidably receiving an upper end 41 of an exterior support frame 40, best shown in FIG. 2, in various aspects. The slot 25 is adapted to reversibly secure the exterior support frame upper end 41 against the panel exterior surface 21, in various aspects. The exterior support frame 40 is preferably substantially three-dimensional in shape, conforming to the shape of the back of a user, in various aspects. The exterior support frame 40 is substantially rigid, in various aspects. The exterior support frame 40 has a lower end 42 that is secured to a waist belt 50, in various aspects. Shoulder straps 52 and padding 54 are secured to the waist belt 50, in various aspects. The structure, function, and relationship of the frame slot 25, the exterior support frame 40, the waist belt 50, and the shoulder straps 52 are described in detail in U.S. Pat. No. 8,678,258 (Knight et al.) and U.S. Pat. No. 10,231,534 (Meador, III et al.), the disclosures of which are incorporated herein by reference in their entireties.

The slot 25 is adapted to secure the exterior support frame 40 upper end 41 against the panel exterior surface 21 such that the exterior support frame 40 and the interior support frame 30 are in cooperative alignment with each other through the panel 20, in various aspects. The exterior support frame 40 upper end 41 is substantially rigid and the interior support frame 30 is flexible and resilient so that the interior support frame 30 conforms to the shape of the exterior support frame 40 when the exterior support frame 40 upper end 41 is inserted into the slot 25, shown in FIG. 9, and the interior support frame 30 returns to its original substantially planar shape when the exterior support frame 40 upper end is removed from the slot 25, shown in FIG. 8, in various aspects.

When the exterior support frame 40 is inserted into the slot 25 and the backpack 10 is donned by a user, the exterior support frame 40 and the interior support frame 30 cooperate to transfer the weight of the backpack 10 and its contents to the waist belt 50 of the user rather than to the shoulders and back of the user, in various aspects. When the exterior support frame 40 is inserted into the slot 25, the exterior support frame 40 places tension on the interior support frame 30 by shifting the panel 20 adjacent the slot to conform to the shape of the exterior support frame 40 which, in turn, forces a change of shape to the flexible interior support frame 30, thus integrating the exterior support frame 40 and the interior support frame 30 together. Once the exterior support frame 40 is inserted into the slot 25, the interior support frame 30 integrates with and functionally becomes an extension of the exterior support frame 30, creating a much stronger support system that facilitates a more stable and efficient weight transfer of the container load from the shoulders and back to the hips and legs of the user.

The foregoing discussion along with the Figures discloses and describes various exemplary implementations. These implementations are not meant to limit the scope of coverage, but, instead, to assist in understanding the context of the language used in this specification and in the claims. The Abstract is not intended to identify key elements of the apparatus and methods disclosed herein or to delineate the scope thereof. Upon study of this disclosure and the exemplary implementations herein, one of ordinary skill in the art may readily recognize that various changes, modifications and variations can be made thereto without departing from the spirit and scope of the inventions as described herein and as defined in the following claims.

The invention claimed is:

1. A backpack having an integrated support system, comprising:
   a) a container having a top, a bottom, a front, and a back, the container back comprising a panel having an exterior surface and an interior surface;
   b) an interior support frame secured to the panel interior surface;
   c) an exterior support frame having an upper end and a lower end;
   d) a waist belt secured to the exterior support frame lower end; and
   e) shoulder straps secured to the exterior support frame;
   f) wherein the container back is adapted to reversibly secure the exterior support frame upper end against the panel exterior surface such that the exterior support frame and the interior support frame are in cooperative alignment with each other through the panel;
   g) wherein the exterior support frame upper end is substantially rigid and the interior support frame is flexible and resilient such that the interior support frame conforms to the shape of the exterior support frame upper end when the exterior support frame upper end is secured to the container back and the interior support frame returns to its original shape when the exterior support frame upper end is removed from the container back;
   h) wherein the exterior support frame and the interior support frame cooperate to transfer the weight of the backpack and its contents to the waist belt of a user donning the backpack.

2. A backpack according to claim 1, wherein the container back has a frame slot formed along an upper end of the panel exterior surface for reversibly securing the exterior support frame upper end against the panel exterior surface.

3. A backpack having an integrated support system, comprising:
   a) a container having a top, a bottom, a front, and a back, the container back comprising a panel having an exterior surface and an interior surface, the container back having a frame slot formed along an upper end of the panel exterior surface;
   b) an interior support frame secured to the panel interior surface;
   c) an exterior support frame having an upper end and a lower end;
   d) a waist belt secured to the exterior support frame lower end; and
   e) shoulder straps secured to the exterior support frame;
   f) wherein the frame slot is adapted to reversibly secure the exterior support frame upper end against the panel exterior surface such that the exterior support frame and the interior support frame are in cooperative alignment with each other through the panel;
   g) wherein the exterior support frame upper end is substantially rigid and the interior support frame is flexible and resilient such that the interior support frame conforms to the shape of the exterior support frame upper end when the exterior support frame upper end is inserted into the frame slot and the interior support frame returns to its original shape when the exterior support frame upper end is removed from the frame slot;
   h) wherein the exterior support frame and the interior support frame cooperate to transfer the weight of the backpack and its contents to the waist belt of a user donning the backpack.

4. A backpack having an integrated support system, comprising:
   a) a container having a top, a bottom, a front, and a back, the container back comprising a panel having an exterior surface and an interior surface;
   b) an interior support frame secured to the panel interior surface;
   c) an exterior support frame secured to the panel exterior surface, the exterior support frame having an upper end and a lower end;
   d) a waist belt secured to the exterior support frame lower end; and
   e) shoulder straps secured to the exterior support frame;
   f) wherein the exterior support frame and the interior support frame are in cooperative alignment with each other through the panel;

g) wherein the exterior support frame upper end is substantially rigid and the interior support frame is flexible and resilient such that the interior support frame conforms to the shape of the exterior support frame upper end when the exterior support frame upper end is secured to the container back;

h) wherein the exterior support frame and the interior support frame cooperate to transfer the weight of the backpack and its contents to the waist belt of a user donning the backpack.

* * * * *